US007284812B2

(12) United States Patent
Marietti et al.

(10) Patent No.: US 7,284,812 B2
(45) Date of Patent: Oct. 23, 2007

(54) COLOUR INK-JET PRINTING METHOD WITH OPTIMIZED NUMBER OF DEPOSITED DROPLETS AND CORRESPONDING PRINTER

(75) Inventors: Jean Paul Marietti, Greasque (FR); Philippe Sarra-Bournet, Aix en Provence (FR)

(73) Assignee: Gemplus, Gemenos (FR)

( * ) Notice: Subject to any disclaimer, the term of this patent is extended or adjusted under 35 U.S.C. 154(b) by 214 days.

(21) Appl. No.: 10/534,061

(22) PCT Filed: Nov. 6, 2003

(86) PCT No.: PCT/FR03/03314

§ 371 (c)(1),
(2), (4) Date: May 6, 2005

(87) PCT Pub. No.: WO2004/043700

PCT Pub. Date: May 27, 2004

(65) Prior Publication Data

US 2006/0061611 A1 Mar. 23, 2006

(30) Foreign Application Priority Data

Nov. 8, 2002 (FR) ..... 02 14057

(51) Int. Cl.
*B41J 2/205* (2006.01)

(52) U.S. Cl. ..... 347/15; 347/43; 358/1.2

(58) Field of Classification Search ..... 347/15, 347/43, 19, 40; 358/1.2, 1.9
See application file for complete search history.

(56) References Cited

U.S. PATENT DOCUMENTS 6,290,330 B1 * 9/2001 Torpey et al. ..... 347/43
6,435,657 B1 8/2002 Couwenhoven et al.
6,827,423 B1 * 12/2004 Katakura et al. ..... 347/40

FOREIGN PATENT DOCUMENTS

EP 0 388 978 A 9/1990
EP 0 832 751 A 4/1998
EP 0 919 388 A 6/1999

* cited by examiner

*Primary Examiner*—Lamson Nguyen
(74) *Attorney, Agent, or Firm*—Buchanan Ingersoll & Rooney PC

(57) ABSTRACT

A a color ink-jet printer has at least four ink cartridges each containing one basic color selected from among yellow, magenta, cyan and black, and at least one additional cartridge containing a basic pale color ink. A processor receives a printing order containing data concerning the requested color and/or the number and color of the ink droplets to be deposited on one another at a specific location of a selected printing substrate. The processor includes an optimizing mode capable of matching the requested color and/or the required number and color of droplets to be superimposed to obtain a selected color at a given pixel with an equivalent color and/or an equivalent number and/or color of droplets to be superimposed to obtain a substantially equivalent and satisfactory color rendering in conformity with the human eye sensory response. The thus-determined equivalent color and/or the equivalent number and color of droplets to be superimposed is applied to the printer for each printing order received.

12 Claims, 2 Drawing Sheets

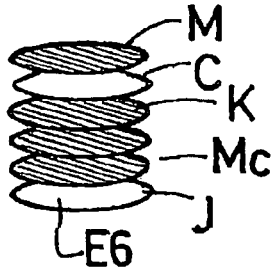
FIG.1
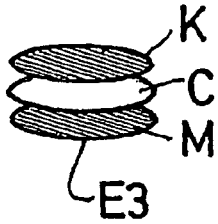
FIG.2
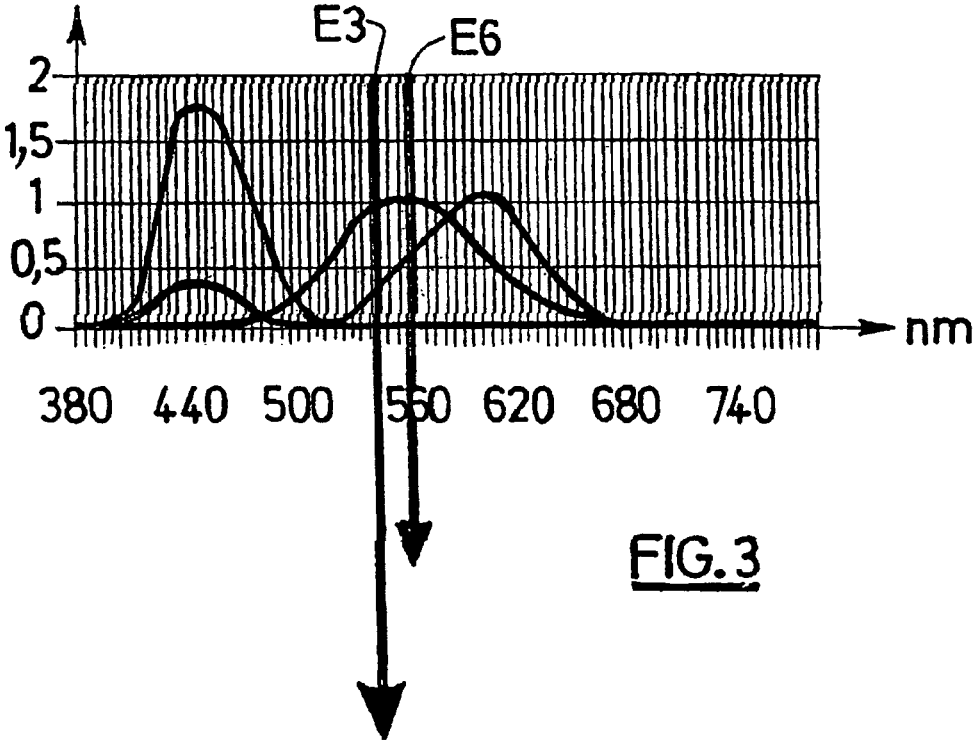
FIG.3
TAB
| | | | | | |
|---|---|---|---|---|---|
| CD1 | Xx+M+$M_{pale}$ | Xx+M | CE1 | 1 | G1 |
| CD2 | Xx+ C+ $C_{pale}$ | Xx+C | CE2 | 1 | G2 |
| CD3 | Xx+K+$K_{pale}$ | Xx+C | CE3 | 1 | G3 |
| CD4 | Xx+C+$C_{pale}$ M+$M_{pale}$ | Xx+M+C | CE4 | 2 | G4 |
| CD5 | Xx+K+$K_{pale}$+C+$C_{pale}$+M $M_{pale}$ | Xx+K+M+C | CE5 | 3 | G5 |
ED1 ED2 ED3 EE1 EE2 ED4 ED5 EE3 EE4 EE5
FIG.4

COLOUR INK-JET PRINTING METHOD WITH OPTIMIZED NUMBER OF DEPOSITED DROPLETS AND CORRESPONDING PRINTER

This disclosure is based upon French Application No. 02/14057, filed Nov. 8, 2002, and International Application No. PCT/FR2003/003314, filed Nov. 6, 2003, the contents of which are incorporated herein by reference.

The present invention concerns colour ink-jet printing using an ink-jet printer comprising a plurality of cartridges each containing an ink to be sprayed in the form of droplets onto a print medium.

It finds a general application in the optimisation of colour ink-jet printing with a view to reducing the thickness of the ink deposit at a given location, referred to as a pixel, and to reduce accordingly the consumption of ink, without affecting the sensory response of the human eye.

In general terms, ink-jet printers comprise four cartridges each containing a basic or primary colour, namely yellow, magenta, cyan and black.

In order to increase the final rendition of the image, in particular in photography, some printers also comprise supplementary cartridges containing primary colour inks referred to as "pale", such as pale magenta, pale cyan and pale black.

The use of a printer equipped with seven cartridges each containing one of these seven colours makes it possible to resolve the lack of resolution of ink-jet technology.

However, such a use of the seven colours gives rise to problems of excessive thickness of the ink droplets liable to be superimposed in a pixel as well as high ink consumption.

The present invention affords a solution to these problems.

It relates to a printing method of a colour ink-jet printer of the type comprising at least four ink cartridges each containing a basic colour chosen from amongst yellow, magenta, cyan and black and at least one supplementary cartridge containing an ink of a basic so-called pale colour, and in which a print instruction is received containing information relating to the requested colour and/or to the number and colour of the ink droplets to be superimposed required for obtaining the requested colour in a given pixel of a chosen print medium.

According to a general definition of the invention, the method comprises an optimisation mode in which the requested colour and/or the required number and colour of the droplets to be superimposed in order to obtain the requested colour at the said pixel is made to correspond to an equivalent colour and/or an equivalent number and colour of the droplets to be superimposed making it possible to obtain a substantially equivalent and satisfactory colour rendition in accordance with the sensory response of the human eye, and there are applied to the printer the equivalent colour and/or the equivalent number and colour of the droplets to be superimposed thus determined for each print instruction received.

Thus, by virtue of the method according to the invention, it is possible, without altering the rendition of the printing for the human eye, to reduce the quantity of superimposed droplets and thus to reduce the thickness and quantity of ink deposited in a given pixel.

According to a preferred embodiment of the invention, the equivalent number of droplets to be superimposed is less than the required number of droplets to be superimposed, preferably less than or equal to four or three droplets of ink of different colours when the printer is equipped with at least six ink cartridges.

Preferably the optimisation mode comprises several corresponding levels.

Another object of the present invention is a colour ink-jet printer able to implement the method according to the invention, the said printer being of the type comprising at least four cartridges each containing a basic colour chosen from amongst yellow, magenta, cyan and black and a supplementary cartridge containing a so-called pale basic colour ink, and processing means able to process a print instruction comprising information relating to the requested colour and/or to the required number and colour of the droplets of ink to be superimposed in order to obtain the requested colour in a given pixel of a chosen print medium.

According to another characteristic of the invention, the processing means are able to make the requested colour and/or the required number and colour of droplets to be superimposed in order to obtain the requested colour at the said pixel to correspond to an equivalent colour and/or an equivalent number and colour of the droplets to be superimposed making it possible to obtain a substantially equivalent and satisfactory colour rendition in accordance with the sensory response of the human eye, and to apply to the printer the equivalent colour and/or the equivalent number and colour of the droplets to be superimposed thus determined for each print instruction received.

In practice, the correspondence is established according to a law or a pre-established table of correspondence.

Yet another object of the present invention is software intended to drive a colour ink-jet printer of the type comprising at least four cartridges each containing a basic colour chosen from amongst yellow, magenta, cyan and black and a supplementary cartridge containing a so-called pale basic colour ink, the said software comprising instruction codes able to process a print instruction comprising information relating to the colour requested and/or to the required number and colour of the droplets of ink to be superimposed in order to obtain the requested colour in a given pixel of a chosen print medium.

According to another characteristic of the invention, the instruction codes of the software are able to make the requested colour and/or the number and colour of the droplets to be superimposed required for obtaining the requested colour at the said pixel correspond to an equivalent colour and/or an equivalent number and colour of droplets to be superimposed making it possible to obtain a substantially equivalent and satisfactory colour rendition in accordance with the sensory response of the human eye, and to apply to the printer the equivalent colour and/or the equivalent number and colour of the droplets to be superimposed thus determined for each print instruction received.

Other characteristics and advantages of the invention will emerge in the light of the following detailed description and the drawings, in which:

FIG. 1 depicts the stacking of six droplets of different colours without the optimisation method according to the invention, FIG. 2 depicts the stacking of three droplets of different colours having substantially the same rendition as the stacking in FIG. 1 according to the optimisation method according to the invention;

FIG. 3 depicts schematically a curve illustrating a colour reproduced by the stacking of the six droplets of FIG. 1 and a colour reproduced by the stacking of the three droplets of FIG. 2 according to the method according to the invention;

Figure 5:
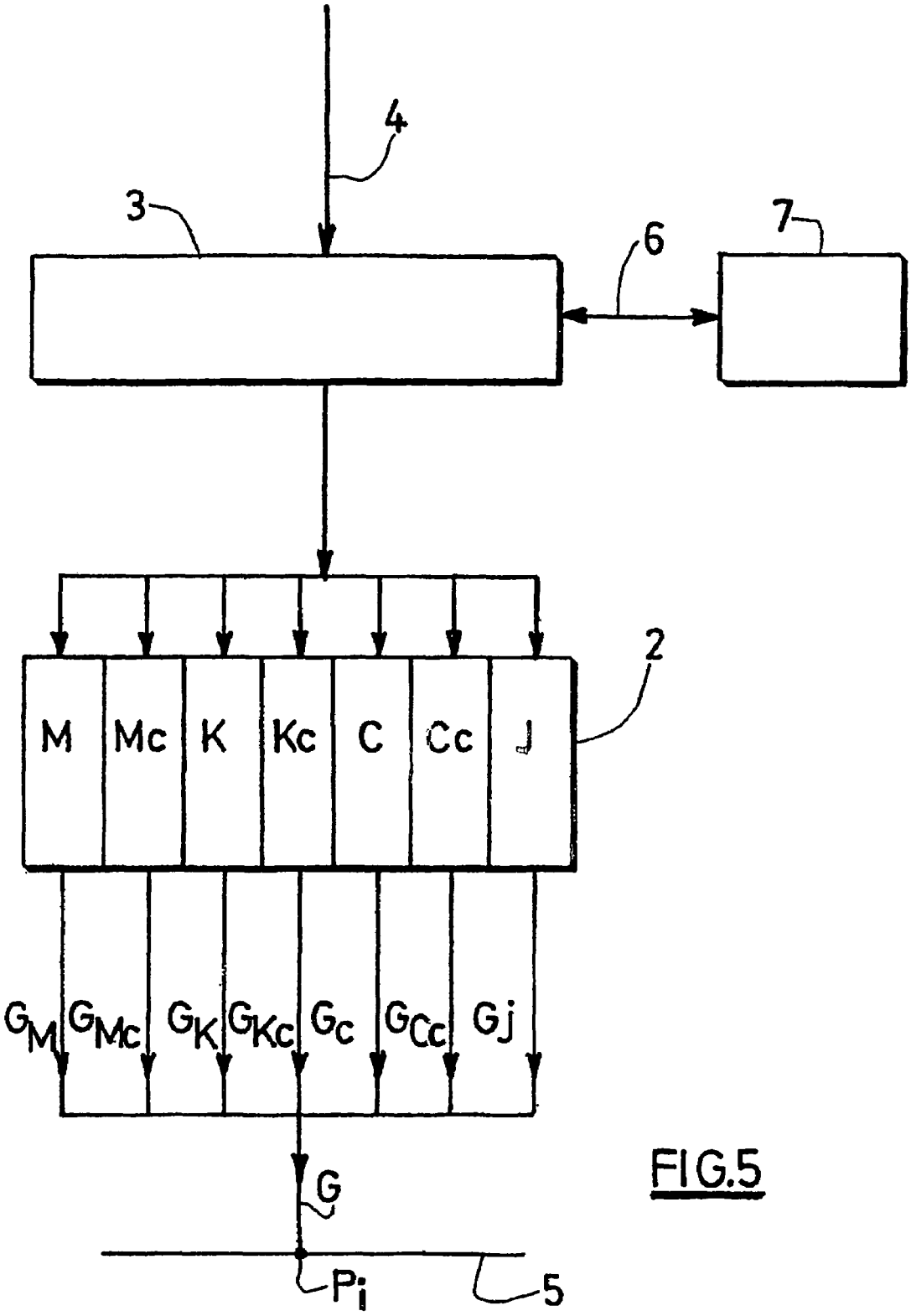

FIG. 4 depicts a table of correspondence according to the invention between the requested colour and/or the number and colour of droplets to be superimposed required for producing several chosen colours in a given pixel on the one hand and an equivalent colour and/or an equivalent number and colour of the droplets to be superimposed making it possible to obtain a substantially equivalent and satisfactory colour rendition according to the sensory response of the human eye on the other hand, and FIG. 5 is a schematic view representing a printer able to implement the steps of the optimisation method according to the invention.

The present invention adapts to any colour ink-jet printing method.

In practice, a colour ink-jet printer comprises four cartridges each containing a colour chosen from amongst the four basic colours: yellow J, magenta M, cyan C and black K.

In order to increase the final rendition of the image, it is known how to associate, with these four basic colour ink cartridges, supplementary cartridges containing pale colour inks such as pale magenta Mpale, pale cyan Cpale and pale black Kpale.

For example, with reference to FIG. 1, a stacking E6 of six droplets of ink of different colours (here yellow J, pale magenta Mpale, black K, cyan C and magenta M) is produced as a given pixel of a given print medium from a printer with seven cartridges.

Such a stacking E6 has a colour rendition with a wavelength of around 560 nm (FIG. 3).

Surprisingly, the applicant found that a stacking E3 (FIG. 2) of three droplets of ink of different colours (here magenta M, cyan C and black K) has a colour rendition with a wavelength, here around 550 nm, substantially equivalent to that of the stacking E6, and that the spectral shift between the two colour renditions (here around 10 nm) does not affect the sensory response of the human eye, or only very little.

From this finding (obviously achieved under generally similar printing, environment and temperature conditions), the applicant established a law or table of correspondence TAB (FIG. 4) between several requested colours and/or the number and colour of the droplets to be superimposed required for reproducing the said requested colours as a given pixel on the one hand and equivalent colours and/or equivalent numbers and colours of droplets to be superimposed making it possible to obtain a substantially equivalent and satisfactory colour rendition in accordance with the sensory response of the human eye on the other hand.

For example, to the requested colour CD5, there is allocated the requested stacking ED5 formed by:

an ink droplet of colour Xx chosen from amongst the seven cartridges, a black ink droplet K, a pale black ink droplet Kpale, a cyan ink droplet C, a pale cyan ink droplet Cpale, a magenta ink droplet M, and a pale magenta ink droplet Mpale.

According to the invention, without substantially affecting the response of the human eye, the requested colour CD5 and/or the stacking ED5 are replaced by the equivalent colour CE5 and/or the equivalent stacking EE5 formed by an ink droplet of colour Xx, an ink droplet of colour black K, an ink droplet of magenta M, and an ink droplet of cyan colour C.

The method according to the invention thus makes it possible to obtain a reduction G5 of three droplets of ink.

Naturally, other correspondences can be established between the requested colours and the equivalent colours as well as between the number and colour of the required droplets and the number and colour of the equivalent droplets.

In practice, the law or table of correspondence TAB is established in advance before executing the method of optimising the deposition of ink.

The optimisation method can also comprise several correspondence levels, for example fine, coarse or normal. To each level there is allocated a threshold whose value corresponds to a spectral shift (expressed in nm) between the requested colour and the equivalent colour. For example, the spectral shift corresponding to the coarse level is greater than 20 nm whilst the spectral shift of the fine level is less than 10 nm.

The applicant obtained a saving of around 25% on the quantity of ink used to print logos on chip cards with a droplet volume of around 18 picolitres and an average volume per face of around 60 microlitres with the optimisation method according to the invention.

With reference to FIG. 5, the implementation of the optimisation method is shown in a colour ink-jet printer such as the one sold by the company EPSON under the reference Stylus series PHOTO 850, 890, 950.

The colour ink-jet printer 1 comprises for example six to eight cartridges 2, four cartridges of which each contain a colour chosen from amongst the four basic colours, yellow J, magenta M, cyan C and black K and two, three or four cartridges of which contain inks of pale colour chosen from amongst pale magenta Mpale, pale cyan Cpale and pale black Kpale.

Conventionally, a controller or driver 3 for the printer 1 receives a print instruction 4 comprising information relating to the request for a colour CC and/or to the number and colour of the ink droplets G to be superimposed in order to reproduce a chosen colour at a given location, referred to as the pixel Pi, on a chosen print medium 5.

For example, the instruction 4 emanates from an image processor (not shown) of the RIP type, standing for "Raster image processor" resident in a distant computer (not shown) containing the digital image to be printed. In a variant, the RIP processor resides in the printer 1.

The controller 3 consults, via the connection 6, a memory 7 containing a table TAB or law of correspondence between the requested colour and/or the required number and colour of the droplets to be superimposed ED in order to reproduce at least one colour chosen as a given pixel on the one hand and an equivalent colour CE and/or an equivalent number and colour of droplets to be superimposed EE making it possible to obtain a substantially equivalent and satisfactory colour rendition in accordance with the sensory response of the human eye on the other hand.

In a variant, the correspondence is established by software whose instruction codes are executed by the controller 3 or another microprocessor (not shown). The instruction codes of the software are contained in a memory medium (not shown).

The controller 3 actuates the print head (not shown) containing the ink cartridges 2 according to the equivalent colour CE and/or the equivalent number and colour of the droplets to be superimposed EE thus determined for each requested colour CD and/or for each requested stacking ED.

The print head thus actuated brings the ink from the ink cartridges 2 to the nozzles (not shown) of the print head of the printer with the view to being expelled in the form of droplets G in accordance with the equivalent colour CE and/or the equivalent number and colour of the droplets to be superimposed EE thus determined.

The invention claimed is:

1. A method for printing with a color ink-jet printer having at least four ink cartridges respectively containing basic colors and at least one supplementary cartridge containing an ink of a pale color, wherein a requested color can comprise a plurality of component colors selected from said basic colors and said pale color, and the printing of a requested color is performed by depositing a drop of ink for each of said component colors, superimposed upon one another, said method comprising the following steps:

for each of a plurality of requestable colors, establishing an equivalent color having a smaller amount of components than the requestable color;

storing said equivalent colors in association with the corresponding requestable colors;

in response to a request to print a color at a location for a given pixel, retrieving the stored equivalent color for the requested color; and depositing a drop of ink for each component of the retrieved equivalent color at said location, to thereby print said equivalent color in place of the requested color for said pixel.

2. The method of claim 1, wherein the printer has a plurality of supplementary cartridges, and said pale colors are selected from the group consisting of pale magenta, pale cyan and pale black.

3. The method of claim 1, wherein said equivalent colors are stored in the form of a table.

4. The method of claim 1, wherein an equivalent color has a wavelength that Is sufficlently close to Its corresponding requestable color so as to present substantially the same sensory perception to a humen observer.

5. The method of claim 4, wherein the difference is wavelength between the requestable and equivalent colors is no greater than 20 nm.

6. The method of claim 1, wherein, for each of at least some of said requestable colors, a plurally of equivalent colors are established for different respective levels of correspondence.

7. The method of claim 6, wherein said different levels of correspondence are respectively associated with different ranges of wavelength difference between the requestable color and the equivalent color.

8. A color ink-jet printer comprising:

at least four ink cartridges respectively containing basic colors and at least one supplementary cartridge containing an ink of a pale color, wherein a requested color can comprise a plurality of component colors selected from said basic colors and said pale color;

a memory storing, for each of a plurality of requestable colors, an equivalent color having a smaller amount of components than the requestable color; and a controller that responds to a request to print a color at a location for a given pixel by retrieving the stored equivalent color for the requested color from said memory, and causing said printer to deposit a drop of ink for each component of the retrieved equivalent color at said location, to thereby print said equivalent color in place of the requested color for said pixel.

9. The printer of claim 8, comprising a plurality of supplementary cartridges, wherein said pale colors are selected from the group consisting of pale magenta, pale cyan and pale black.

10. The printer of claim 8, wherein said equivalent colors are stored in said memory in the form of a table.

11. The printer of claim 8, wherein, for each of at least some of said requestable colors, a plurality of equivalent colors are stored for different respective levels of correspondence.

12. The printer of claim 11, wherein said different levels of correspondence are respectively associated with different ranges of wavelength difference between the requestable color and the equivalent color.

* * * * *